US006598677B1

(12) United States Patent
Baugh et al.

(10) Patent No.: US 6,598,677 B1
(45) Date of Patent: Jul. 29, 2003

(54) HANGING LINERS BY PIPE EXPANSION

(75) Inventors: John L. Baugh, Houston, TX (US); Rod Bennett, Houston, TX (US); George Givens, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/315,411

(22) Filed: May 20, 1999

(51) Int. Cl.[7] ..... E21B 23/01; E21B 33/13
(52) U.S. Cl. ..... 166/285; 166/177.4; 166/382
(58) Field of Search ..... 166/177.4, 207, 166/285, 287, 290, 291, 381, 384, 382

(56) References Cited

U.S. PATENT DOCUMENTS

| | | | |
|---|---|---|---|
| 984,449 | A | 2/1911 | Stewart |
| 1,135,809 | A | 4/1915 | Jones |
| 1,233,888 | A | 7/1917 | Leonard |
| 1,634,891 | A | 7/1927 | Trout |
| 2,017,451 | A | 10/1935 | Wickersham |
| 2,214,226 | A | 9/1940 | English |
| 2,447,629 | A | 8/1948 | Beissinger et al. |
| 2,583,316 | A | 1/1952 | Bannister |
| 2,593,725 | A | 4/1952 | Brown |
| 2,812,025 | A | 11/1957 | Teague et al. |
| 3,162,245 | A | 12/1964 | Howard et al. |
| 3,163,217 | A | 12/1964 | Haeber |
| 3,179,168 | A | 4/1965 | Vincent |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,245,471 | A | 4/1966 | Howard |
| 3,297,092 | A | 1/1967 | Jennings |
| 3,353,599 | A | 11/1967 | Swift |
| 3,358,760 | A | 12/1967 | Blagg |
| 3,358,769 | A | 12/1967 | Berry |
| 3,412,565 | A | 11/1968 | Lindsey et al. |
| 3,419,080 | A | 12/1968 | Lebourg |
| 3,477,506 | A | 11/1969 | Malone |

(List continued on next page.)

FOREIGN PATENT DOCUMENTS

| | | |
|---|---|---|
| EP | 353309 | 11/1988 |
| EP | 397874 | 11/1988 |
| EP | 397875 | 11/1988 |
| EP | 377486 | 7/1990 |
| EP | 418 056 | 12/1991 |

(List continued on next page.)

OTHER PUBLICATIONS

Restarick, H.L., SPE 23741, Mechanical Fluid Loss Control Systems Used During Sand Control, 1991, pp. 455–465.
Baker Oil Tools Fishing Services Information, 5 pages, date unknown.
Bowen Information, Composite Catalog, 1 page, date unknown.
Gotco International, Inc. Information, Composite Catalog, 1 page date unknown.
Suman, et al., Primary cementing: Why many conventional jobs fail, reprinted from *World Oil,* 8 pages, Dec. 1982.
"A System: Reeled Completions, Casings and Flowlines," *Reeled Systems Technology,* date unknown, 16–21.
Petroline EST Well Systems brochure, date unknown, 8 pages.

(List continued on next page.)

*Primary Examiner*—Hoang Dang
(74) *Attorney, Agent, or Firm*—Steve Robenblatt

(57) ABSTRACT

A method for securing and sealing one tubular to another down hole facilitates cementing prior to sealing and allows for suspension of one tubular in the other by virtue of pipe expansion techniques.

9 Claims, 11 Drawing Sheets

U.S. PATENT DOCUMENTS

| | | | | | |
|---|---|---|---|---|---|
| 3,489,220 | A | | 1/1970 | Kinley | |
| 3,578,083 | A | | 5/1971 | Anderson | |
| 3,693,717 | A | | 9/1972 | Wuenschel | |
| 3,710,864 | A | | 1/1973 | Mitchell | |
| 3,712,376 | A | | 1/1973 | Owen et al. | |
| 3,746,091 | A | | 7/1973 | Owen et al. | |
| 3,785,193 | A | | 1/1974 | Kinley | |
| 3,857,445 | A | | 12/1974 | Mower | |
| 3,865,408 | A | | 2/1975 | Young | |
| 3,907,034 | A | | 9/1975 | Suman, Jr. | |
| 3,945,444 | A | | 3/1976 | Knudson | |
| 3,948,321 | A | | 4/1976 | Owen et al. | |
| 3,957,114 | A | * | 5/1976 | Streich | 166/285 |
| 4,296,014 | A | | 10/1981 | Hayashi et al. | |
| 4,483,399 | A | | 11/1984 | Colgate | |
| 4,501,327 | A | | 2/1985 | Retz | |
| 4,660,863 | A | | 4/1987 | Bailey et al. | |
| 4,730,851 | A | | 3/1988 | Watts | |
| 4,776,409 | A | | 10/1988 | Manchak, Jr. | |
| 4,781,249 | A | | 11/1988 | Wood | |
| 4,796,709 | A | | 1/1989 | Lynde et al. | |
| 4,830,109 | A | | 5/1989 | Wedel | |
| 4,897,139 | A | | 1/1990 | Wood | |
| 4,907,651 | A | | 3/1990 | Bou-Mikael | |
| 4,967,846 | A | | 11/1990 | Wood | |
| 4,971,152 | A | | 11/1990 | Koster et al. | |
| 4,976,322 | A | | 12/1990 | Abdrakhmanov et al. | |
| 4,977,958 | A | | 12/1990 | Miller | |
| 5,014,779 | A | | 5/1991 | Meling et al. | |
| 5,031,699 | A | | 7/1991 | Artynov et al. | |
| 5,037,879 | A | | 8/1991 | Roberts | |
| 5,040,283 | A | | 8/1991 | Pelgrom | |
| 5,083,608 | A | | 1/1992 | Abdrakhmanov et al. | |
| 5,119,661 | A | | 6/1992 | Abdrakhmanov et al. | |
| 5,327,962 | A | | 7/1994 | Head | |
| 5,333,692 | A | | 8/1994 | Baugh et al. | |
| 5,337,823 | A | | 8/1994 | Nobileau | |
| 5,348,095 | A | | 9/1994 | Worrall et al. | |
| 5,366,012 | A | | 11/1994 | Lohbeck | |
| 5,390,742 | A | | 2/1995 | Dines et al. | |
| 5,456,312 | A | | 10/1995 | Lynde et al. | |
| 5,494,106 | A | | 2/1996 | Gueguen et al. | |
| 5,667,011 | A | | 9/1997 | Gill et al. | |
| 5,785,120 | A | | 7/1998 | Smalley et al. | |
| 5,794,702 | A | | 8/1998 | Nobileau | |
| 5,865,251 | A | | 2/1999 | Rebardi et al. | |
| 6,012,523 | A | * | 1/2000 | Campbell et al. | 166/277 |
| 6,021,850 | A | * | 2/2000 | Wood et al. | 166/380 |
| 6,070,671 | A | * | 6/2000 | Cumming et al. | 166/381 |
| 6,085,838 | A | * | 7/2000 | Vercaemer et al. | 166/227 |
| 6,098,710 | A | * | 8/2000 | Rhein-Knudsen et al. | 166/285 |
| 6,098,717 | A | * | 8/2000 | Bailey et al. | 166/382 |
| 6,112,818 | A | * | 9/2000 | Campbell | 166/384 |

FOREIGN PATENT DOCUMENTS

| | | | | |
|---|---|---|---|---|
| EP | 0881354 | A2 | 12/1998 | |
| GB | 2079819 | A | 1/1982 | |
| GB | 2221482 | | 7/1990 | 33/14 |
| GB | 2296023 | | 6/1996 | 23/1 |
| GB | 2326896 | A | 1/1999 | |
| GB | 2346398 | | 9/2000 | 43/10 |
| JP | 61-067528 | | 4/1986 | |
| RU | 388650 | | 2/1976 | |
| RU | 663825 | | 5/1979 | |
| RU | 746084 | | 7/1980 | |
| RU | 832049 | | 5/1981 | |
| RU | 1813171 | | 4/1993 | |
| SU | 976019 | | 11/1982 | |
| WO | WO 97/17526 | | 5/1997 | |

OTHER PUBLICATIONS

Abdrakhmanov, et al., "Isolation Profile Liner Helps Stabilize Problem Well Bores," *Oil & Gas Journal,* Sep. 1995, 50–52.

Gill, et al., "Expandable Tube is Novel Tool for Difficult Completions, Drilling," *Oil & Fas Journal,* Jun. 1996, 37–40.

Vincent, et al., "Stressed Steel Liner Yields Stronger Casing Repairs," *Journal of Petroleum Technology,* Dec. 1962, 1337–1341.

Kemp, "Field Results of the Stressed Steel Liner casing Patch," *Journal of Petroleum Technology,* Feb. 1964, 147–149.

Weatherford Enterra advertisement, 1 page, 1997.

Weatherford Enterra article, "The Homco Internal Steel Line Casing Patch," 1 page, date unknown.

* cited by examiner

HANGING LINERS BY PIPE EXPANSION

FIELD OF THE INVENTION

The field of this invention relates to suspending one tubular in another, especially hanging liners which are to be cemented.

BACKGROUND OF THE INVENTION

In completing well bores, frequently a liner is inserted into casing and suspended from the casing by a liner hanger. Various designs of liner hangers are known and generally involve a gripping mechanism, such as slips, and a sealing mechanism, such as a packer which can be of a variety of designs. The objective is to suspend the liner during a cementing procedure and set the packer for sealing between the liner and the casing. Liner hanger assemblies are expensive and provide some uncertainty as to their operation down hole.

Some of the objects of the present invention are to accomplish the functions of the known liner hangers by alternative means, thus eliminating the traditionally known liner hanger altogether while accomplishing its functional purposes at the same time in a single trip into the well. Another objective of the present invention is to provide alternate techniques which can be used to suspend one tubular in another while facilitating a cementing operation and still providing a technique for sealing the tubular together. Various fishing tools are known which can be used to support a liner being inserted into a larger tubular. One such device is made by Baker Oil Tools and known as a "Trig-State Type B Casing and Tubing Spear," Product No. 126-09. In addition to known spears which can support a tubing string for lowering into a well bore, techniques have been developed for expansion of tubular down hole. Some of the techniques known in the prior art for expansion of tubular down hole are illustrated in U.S. Pat. Nos. 4,976,322; 5,083,608; 5,119,661; 5,348,095; 5,366,012; and 5,667,011.

SUMMARY OF THE INVENTION

A method for securing and sealing one tubular to another down hole facilitates cementing prior to sealing and allows for suspension of one tubular in the other by virtue of pipe expansion techniques.

DETAILED DESCRIPTION OF THE PREFERRED EMBODIMENT

Figure 1:
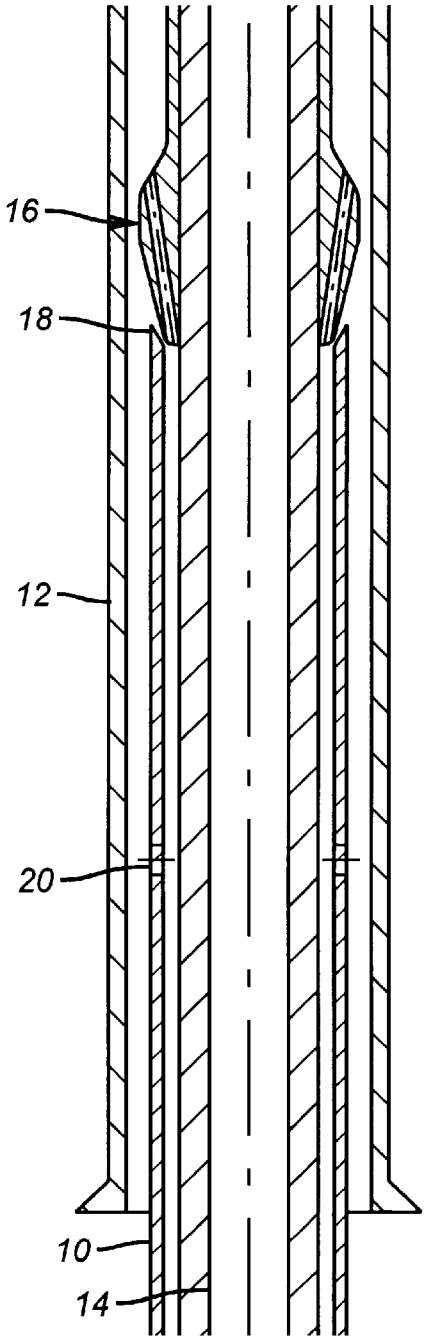
FIGS. 1–4 are a sectional elevation, showing a first embodiment of the method to suspend, cement and seal one tubular to another down hole, using pipe expansion techniques.
Figure 2:
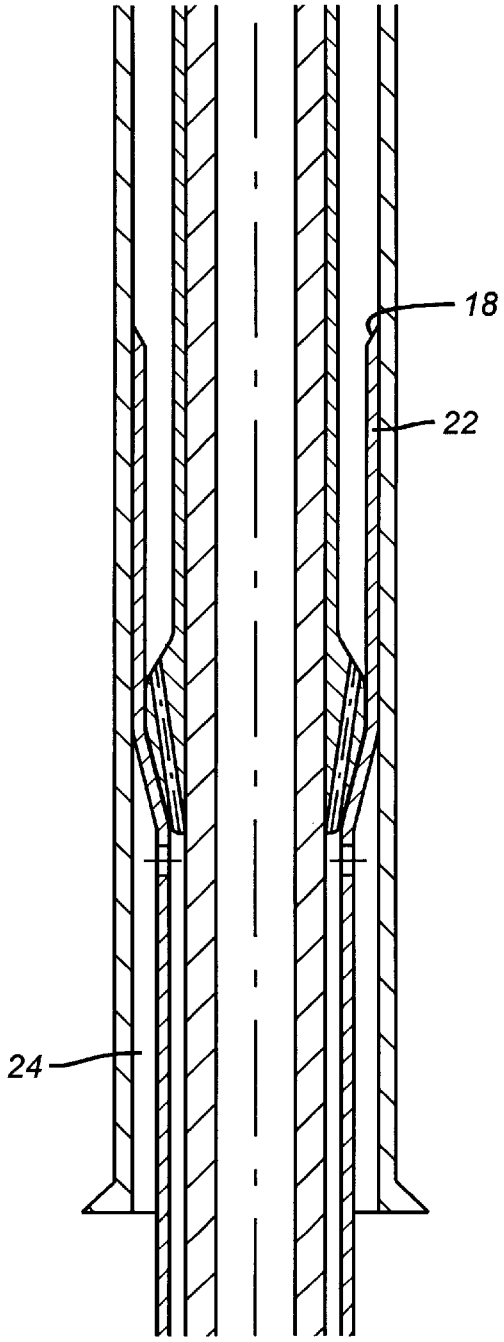
Figure 3:
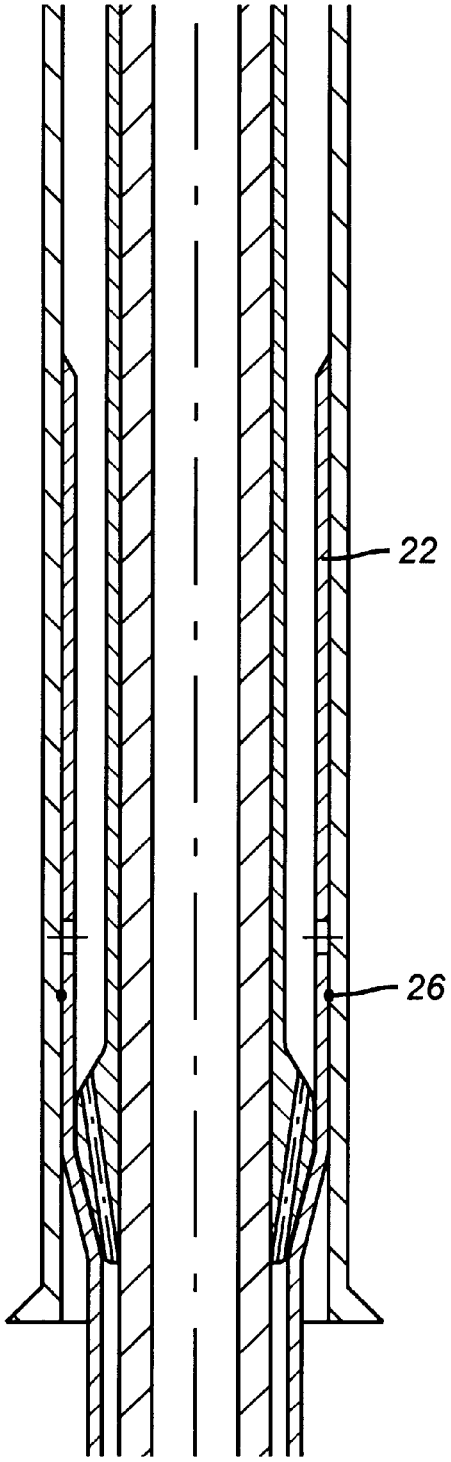
Figure 4:
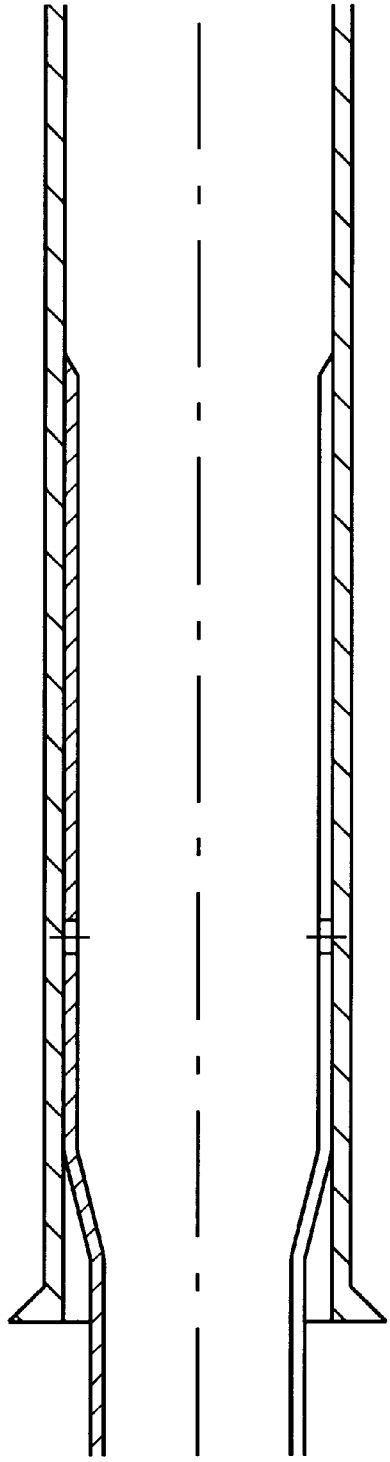
Figure 6:
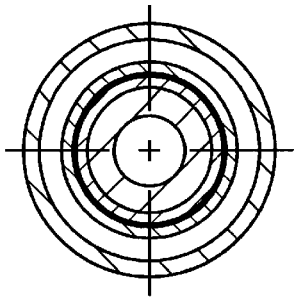
FIGS. 5–11 a are another embodiment creating longitudinal passages for passage of the cementing material prior to sealing the tubular together.

Referring to FIG. 1, a tubular 10 is supported in casing 12, using known techniques such as a spear made by Baker Oil Tools, as previously described. That spear or other gripping device is attached to a running string 14. Also located on the running string 14 above the spear is a hydraulic or other type of stroking mechanism which will allow relative movement of a sewage assembly 16 which moves in tandem with a portion of the running string 14 when the piston/cylinder combination (not shown) is actuated, bringing the sewage 16 down toward the upper end 18 of the tubular 10. As shown in FIG. 1 during run-in, the tubular 10 easily fits through the casing 12. The tubular 10 also comprises one or more openings 20 to allow the cement to pass through, as will be explained below. Comparing FIG. 2 to FIG. 1, the tubular 10 has been expanded radially at its upper end 18 so that a segment 22 is in contact with the casing 12. Segment 22 does not include the openings 20; thus, an annular space 24 exists around the outside of the tubular 10 and inside of the casing 12. While in the position shown in FIG. 2, cementing can occur. This procedure involves pumping cement through the tubular 10 down to its lower end where it can come up and around into the annulus 24 through the openings 20 so that the exterior of the tubular 10 can be fully surrounded with cement up to and including a portion of the casing 12. Before the cement sets, the piston/ cylinder mechanism (not shown) is further actuated so that the sewage assembly 16 moves further downwardly, as shown in FIG. 3. Segment 22 has now grown in FIG. 3 so that it encompasses the openings 20. In essence, segment 22 which is now against the casing 12 also includes the openings 20, thereby sealing them off. The seal can be accomplished by the mere physical expansion of segment 22 against the casing 12. Alternatively, a ring seal 26 can be placed below the openings 20 so as to seal the cemented annulus 24 away from the openings 20. Optionally, the ring seal 26 can be a rounded ring that circumscribes each of the openings 20. Additionally, a secondary ring seal similar to 26 can be placed around the segment 22 above the openings 20. As shown in FIG. 3, the assembly is now fully set against the casing 12. The openings 20 are sealed and the tubular 10 is fully supported in the casing 12 by the extended segment 22. Referring to FIG. 4, the sewage assembly 16, as well as the piston/cylinder assembly (not shown) and the spear which was used to support the tubular 10, are removed with the running string 14 so that what remains is the tubular 10 fully cemented and supported in the casing 12. The entire operation has been accomplished in a single trip. Further completion operations in the well bore are now possible. Currently, this embodiment is preferred.

Figure 8:
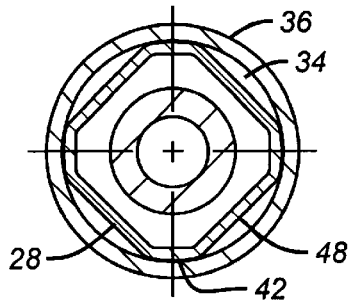
Figure 5:
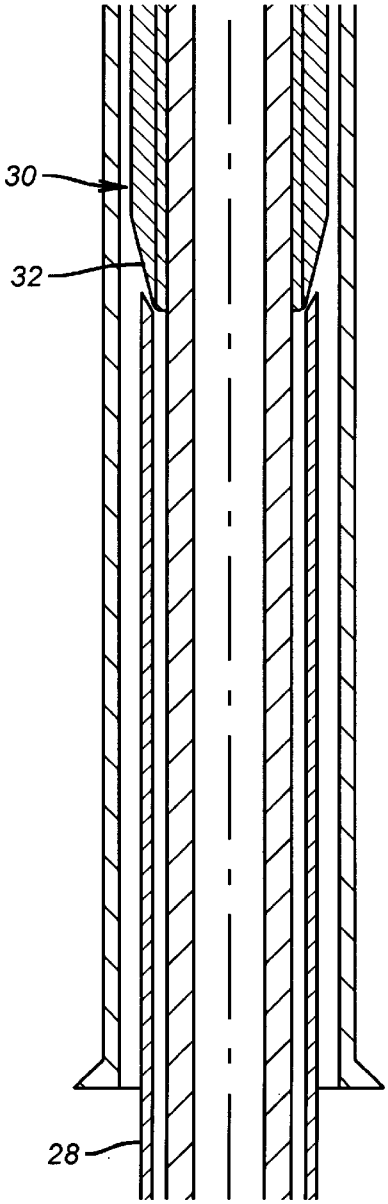
Figure 7:
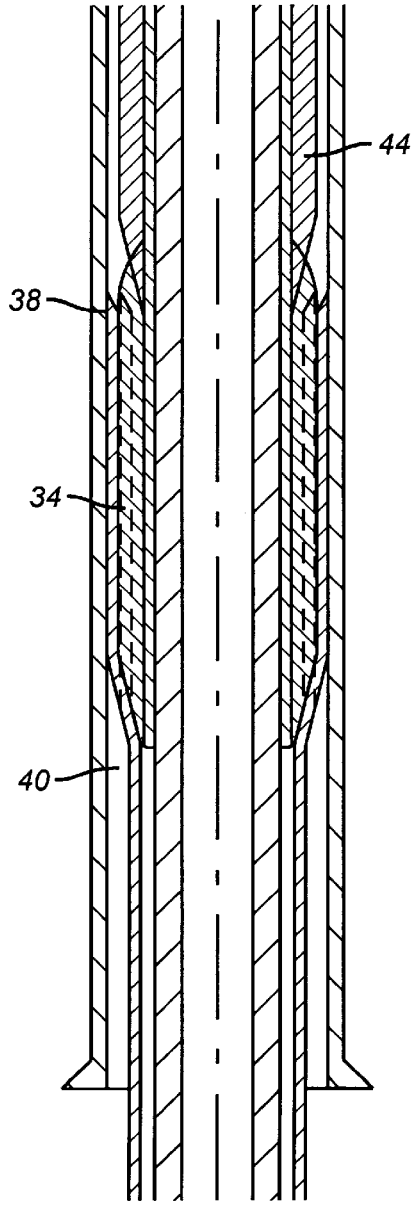
Figure 10:
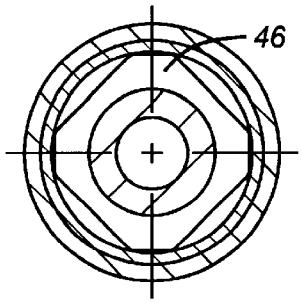
Figure 11A:
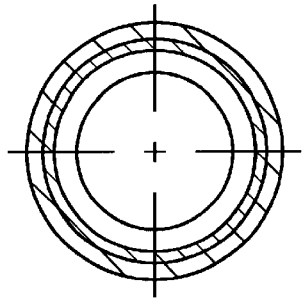
Figure 9:
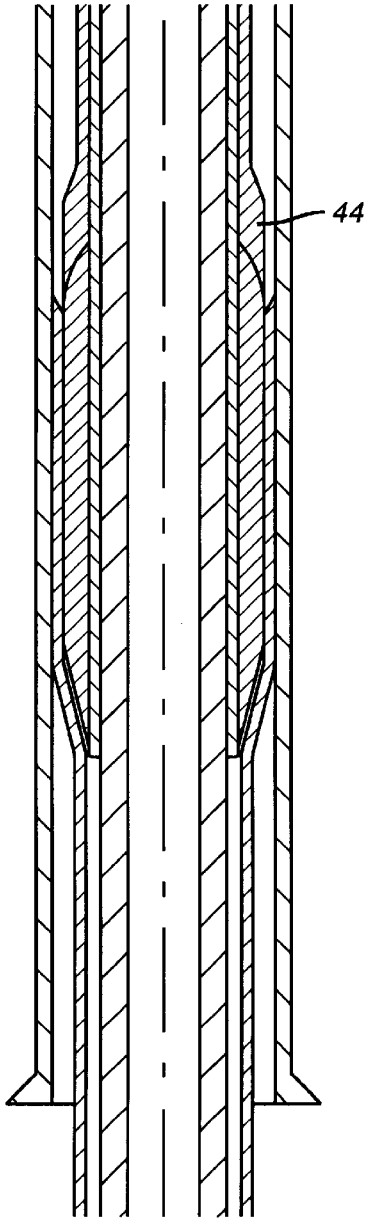
Figure 11:
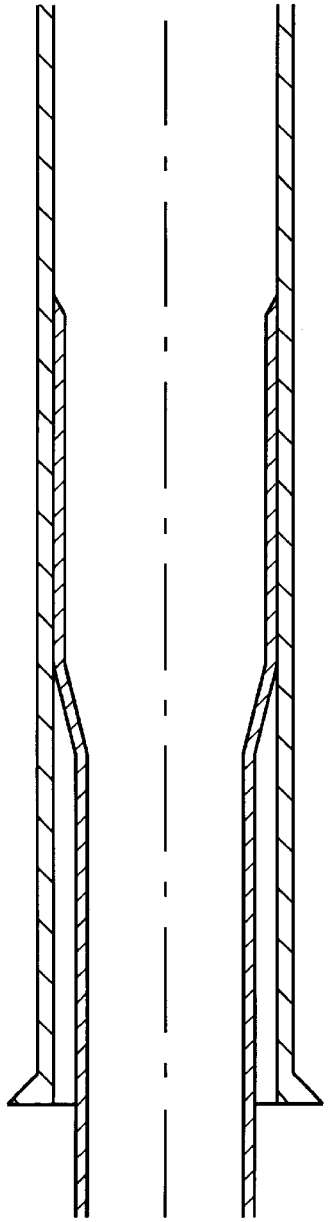

FIGS. 5–12 illustrate an alternative embodiment. Here again, the tubular 28 is supported in a like manner as shown in FIGS. 1–4, except that the sewage assembly 30 has a different configuration. The sewage assembly 30 has a lower end 32 which is best seen in cross-section in FIG. 8. Lower end 32 has a square or rectangular shape which, when forced against the tubular 28, leaves certain passages 34 between itself and the casing 36. Now referring to FIG. 7, it can be seen that when the lower end 32 is brought inside the upper end 38 of the tubular 28, the passages 34 allow communication to annulus 40 so that cementing can take place with the pumped cement going back up the annulus 40 through the passages 34. Referring to FIG. 8, it can be seen that the tubular 28 has four locations 42 which are in contact with the casing 36. This longitudinal surface location in contact with the casing 36 provides full support for the tubular 28 during the cementing step. Thus, while the locations 42 press against the inside wall of the casing 36 to support the tubular 28, the cementing procedure can be undertaken in a known manner. At the conclusion of the cementing operation, an upper end 44 of the sewage assembly 30 is brought down into the upper end 38 of the tubular 28. The profile of the upper end 44 is seen in FIG. 10. It has four locations 46 which protrude outwardly. Each of the locations 46 encounters a mid-point 48 (see FIG. 8) of the upper end 38 of the tubular 28. Thus, when the upper end 44 of the sewage assembly 30 is brought down into the tubular 28, it reconfirms the shape of the upper end 38 of the tubular 28 from the square pattern shown in FIG. 8 to the round pattern shown in FIG. 12. FIG. 11 shows the running assembly and the sewage assembly 30 removed, and the well now ready for the balance of the completion operations. The operation has been accomplished in a single trip into the well bore. Accordingly, the principal difference in the embodiment shown in FIGS. 1–4 and that shown in FIGS. 5–12 is that the first embodiment employed holes or openings to facilitate the flow of cement, while the second embodiment provides passages for the cement with a two-step expansion of the upper end 38 of the tubular 28. The first step creates the passages 34 using the lower end 32 of the sewage assembly 30. It also secures the tubular 28 to the casing 36 at locations 42. After cementing, the upper end 44 of the sewage assembly 30 basically finishes the expansion of the upper end 38 of the tubular 28 into a round shape shown in FIG. 12. At that point, the tubular 28 is fully supported in the casing 36. Seals, as previously described, can optionally be placed between the tubular 28 and the casing 36 without departing from the spirit of the invention.

Figure 12:
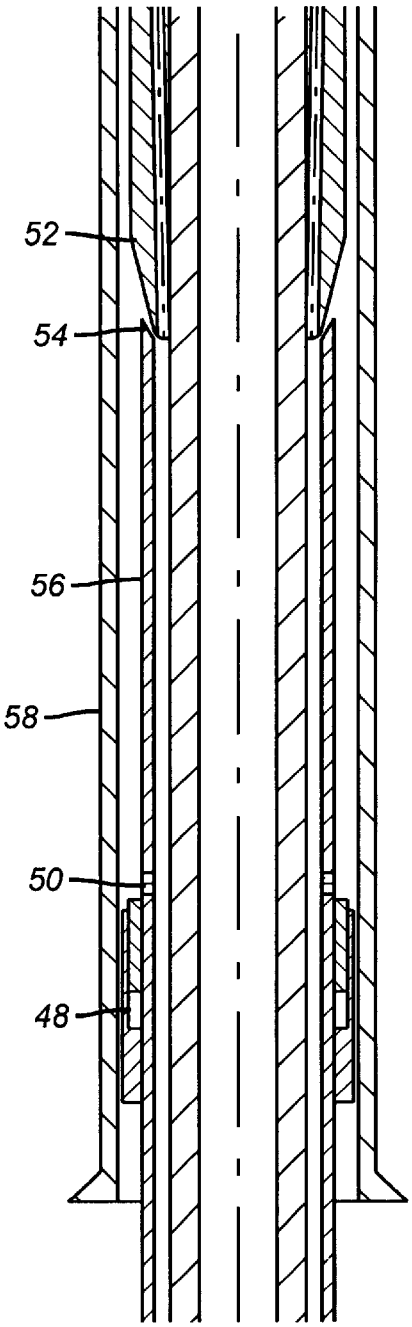
FIGS. 12–15 illustrate yet another embodiment incorporating a sliding sleeve valve for facilitating the cementing step.
Figure 13:
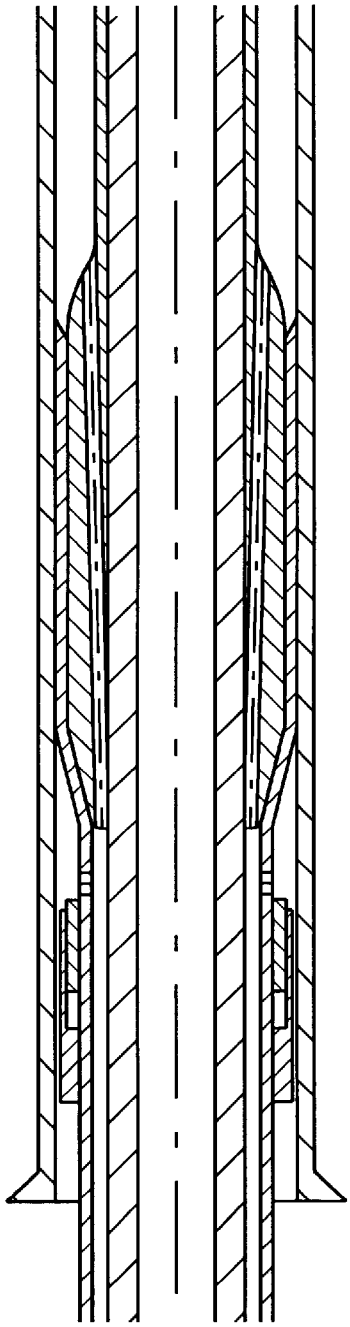
Figure 14:
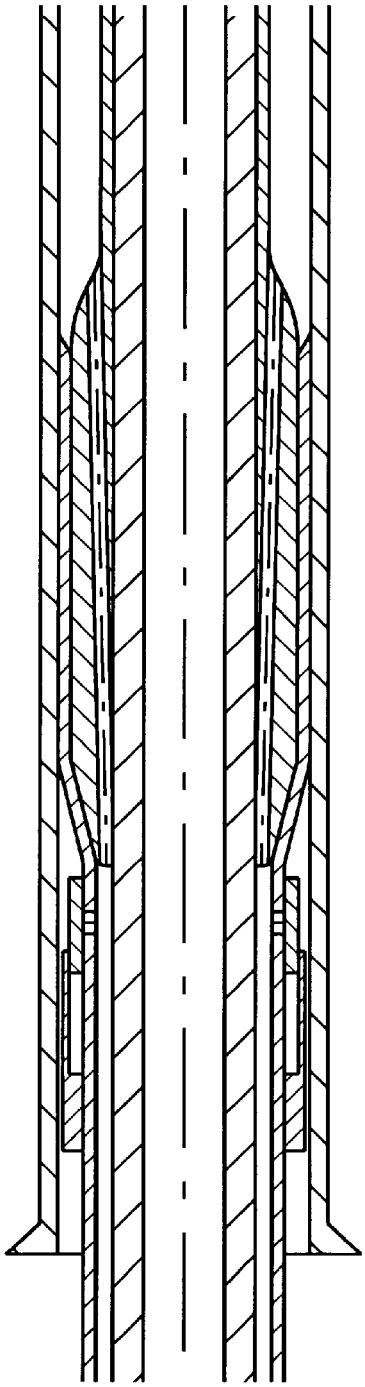
Figure 15:
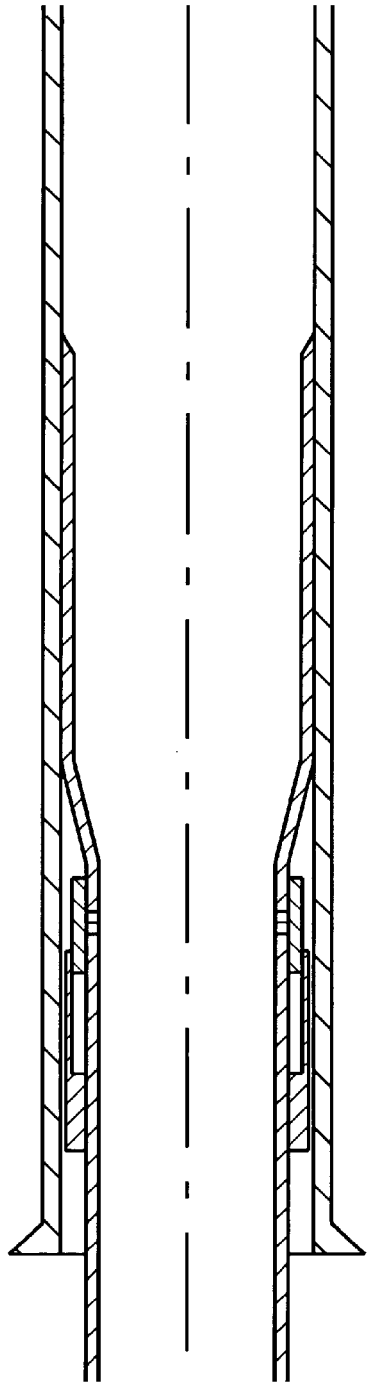

Another embodiment is illustrated in FIGS. 12–15. This embodiment has similarities to the embodiment shown in FIGS. 1–4. One difference is that there is now a sliding sleeve valve 48 which is shown in the open position exposing openings 50. As shown in FIG. 12, a sewage assembly 52 fully expands the upper end 54 of the tubular 56 against the casing 58, just short of openings 50. This is seen in FIG. 13. At this point, the tubular 56 is fully supported in the casing 58. Since the openings 50 are exposed with the sliding sleeve valve 48, cementing can now take place. At the conclusion of the cementing step, the sliding sleeve valve 48 is actuated in a known manner to close it off, as shown in FIG. 14. Optionally, seals can be used between tubular 56 and casing 58. The running assembly, including the sewage assembly 52, is then removed from the tubular 56 and the casing 58, as shown in FIG. 15. Again, the procedure is accomplished in a single trip. Completion operations can now continue in the well bore.

Figure 17A:
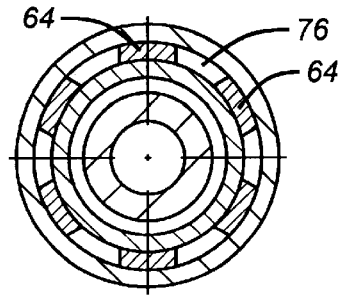
FIGS. 16–19 illustrate the use of a grapple technique to suspend the tubular inside a bigger tubular, leaving spaces between the grappling members for passage of cement prior to sealing between the tubular.
Figure 16:
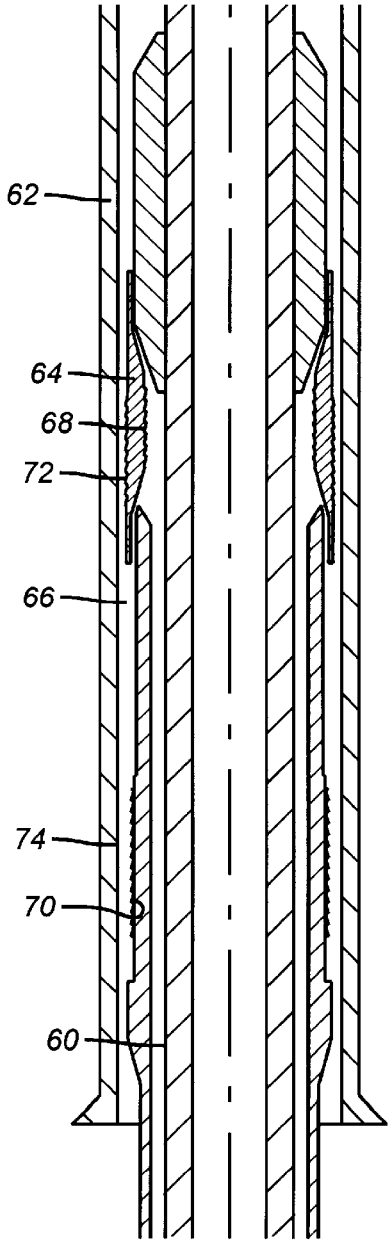
Figure 17:
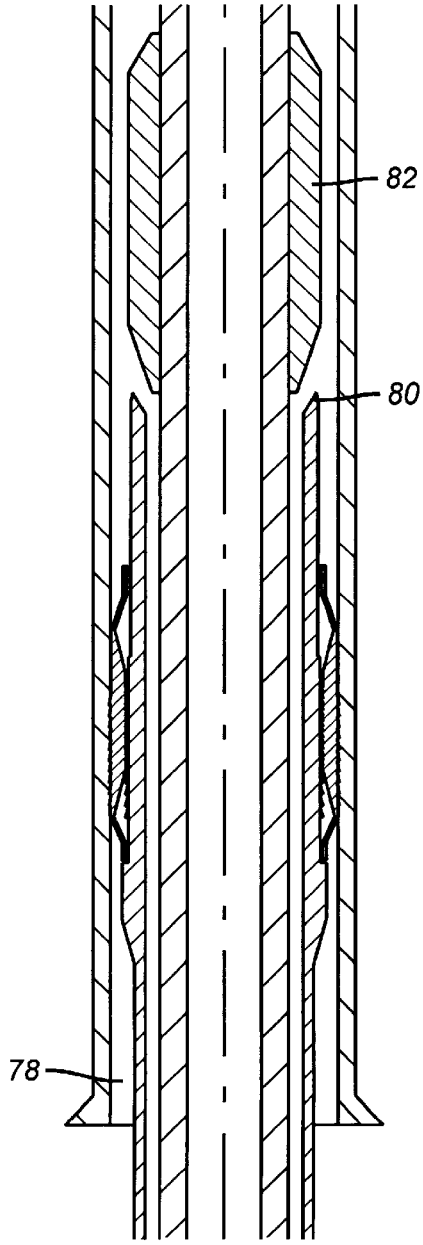
Figure 18:
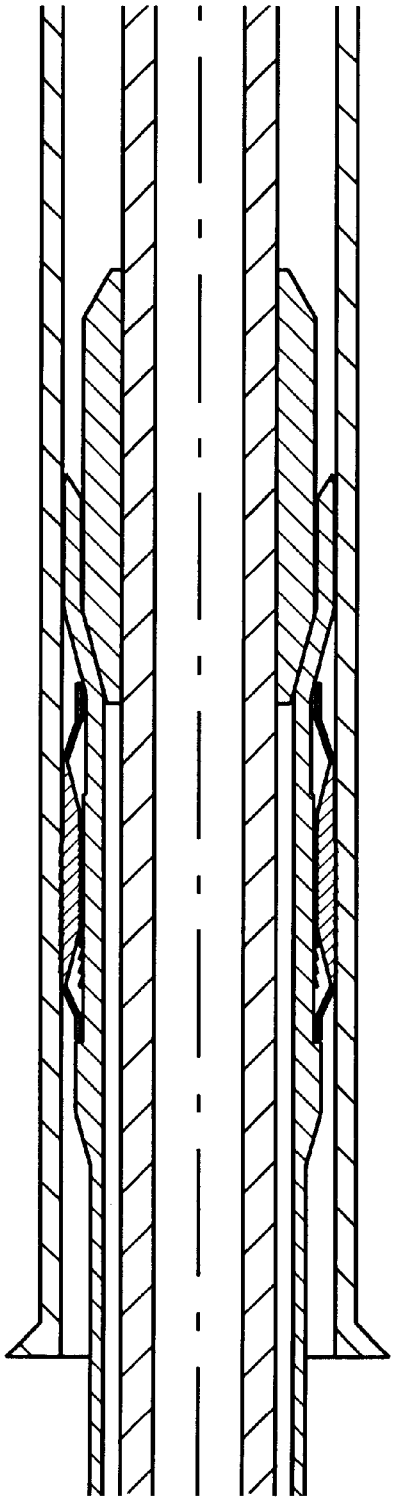
Figure 19:
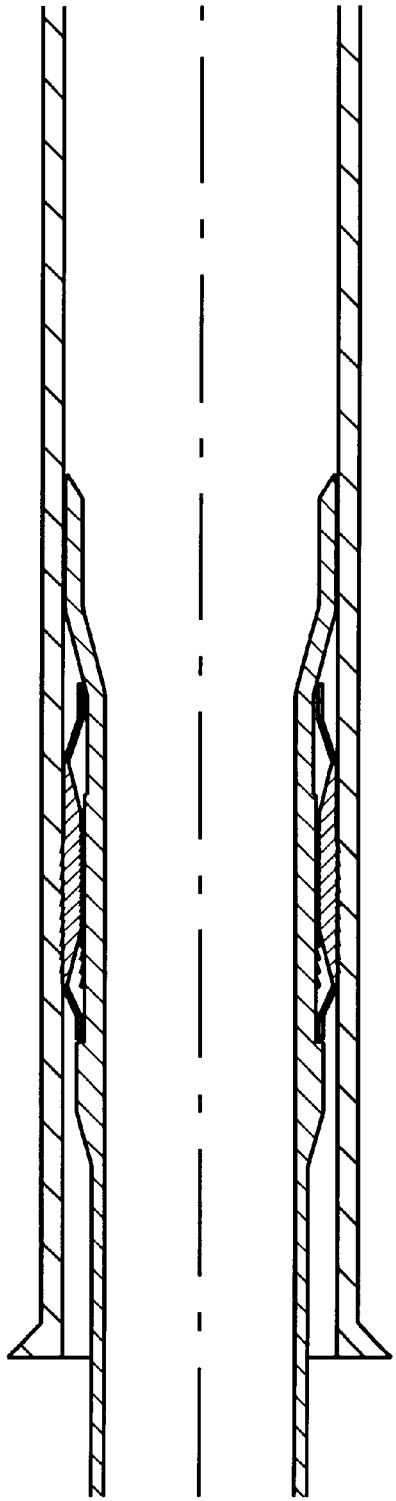
Figure 22:
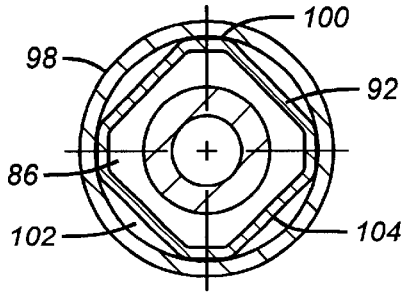
FIGS. 20–26 illustrate an alternative embodiment involving a sequential flaring of the inner tubular from the bottom up.
Figure 20:
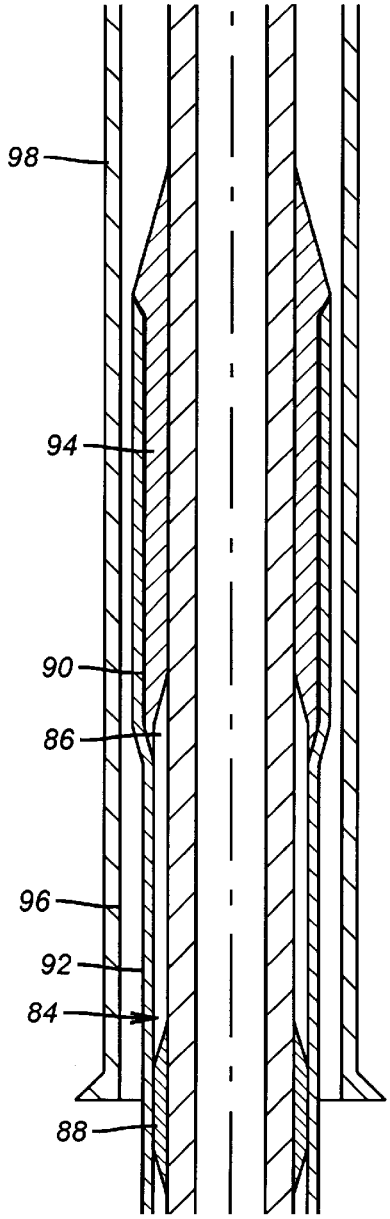

FIGS. 16–19 illustrate another technique. The initial support of the tubular 60 to the casing 62 is accomplished by forcing a grapple member 64 down into an annular space 66 such that its teeth 68 ratchet down over teeth 70, thus forcing teeth 72, which are on the opposite side of the grappling member 64 from teeth 68, to fully engage the inner wall 74 of the casing 62. This position is shown in FIG. 17, where the teeth 68 and 70 have engaged, thus supporting the tubular 60 in the casing 62 by forcing the teeth 72 to dig into the inner wall 74 of the casing 62. The grapple members 64 are elongated structures that are placed in a spaced relationship as shown in FIG. 17A. The spaces 76 are shown between the grapple members 64. Thus, passages 76 provide the avenue for cement to come up around annulus 78 toward the upper end 80 of the tubular 60. At the conclusion of the cementing, the sewage assembly 82 is brought down into the upper end 80 of the tubular 60 to flare it outwardly into sealing contact with the inside wall 74 of the casing 62, as shown in FIG. 18. Again, a seal can be used optionally between the upper end 80 and the casing 62 to seal in addition to the forcing of the upper end 80 against the inner wall 74, shown in FIG. 18. The running assembly as well as the sewage assembly 82 is shown fully removed in FIG. 19 and further down hole completion operations can be concluded. All the steps are accomplished in a single trip.

Figure 21:
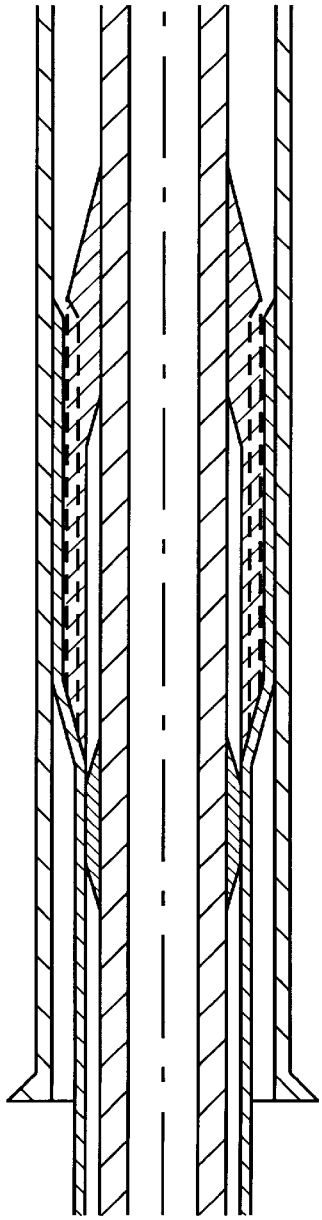
Figure 24:
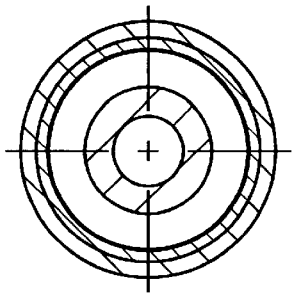
Figure 26:
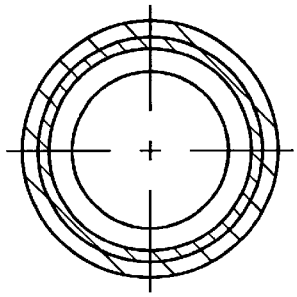
Figure 23:
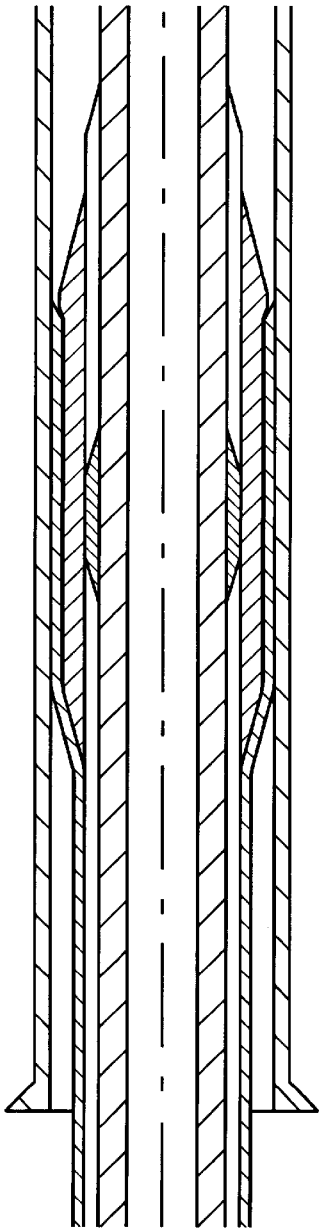
Figure 25:
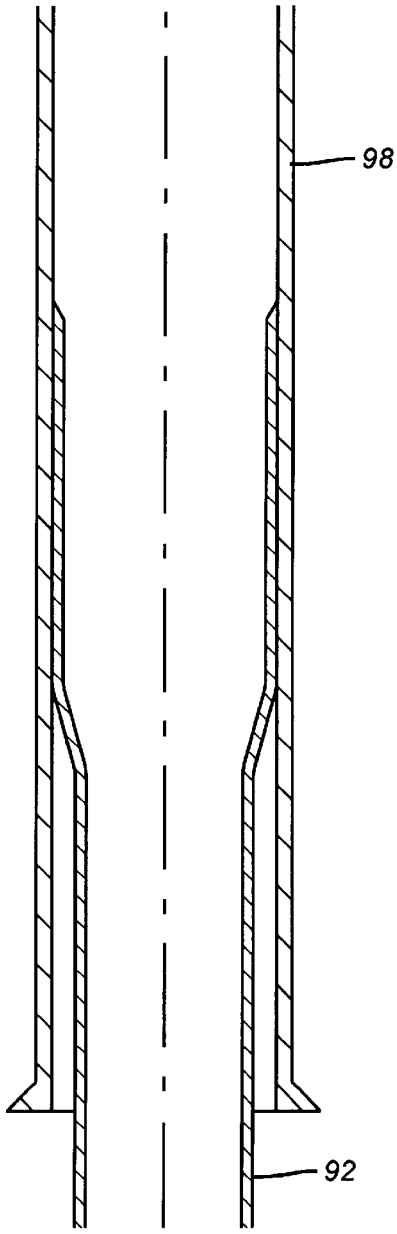
Figure 27:
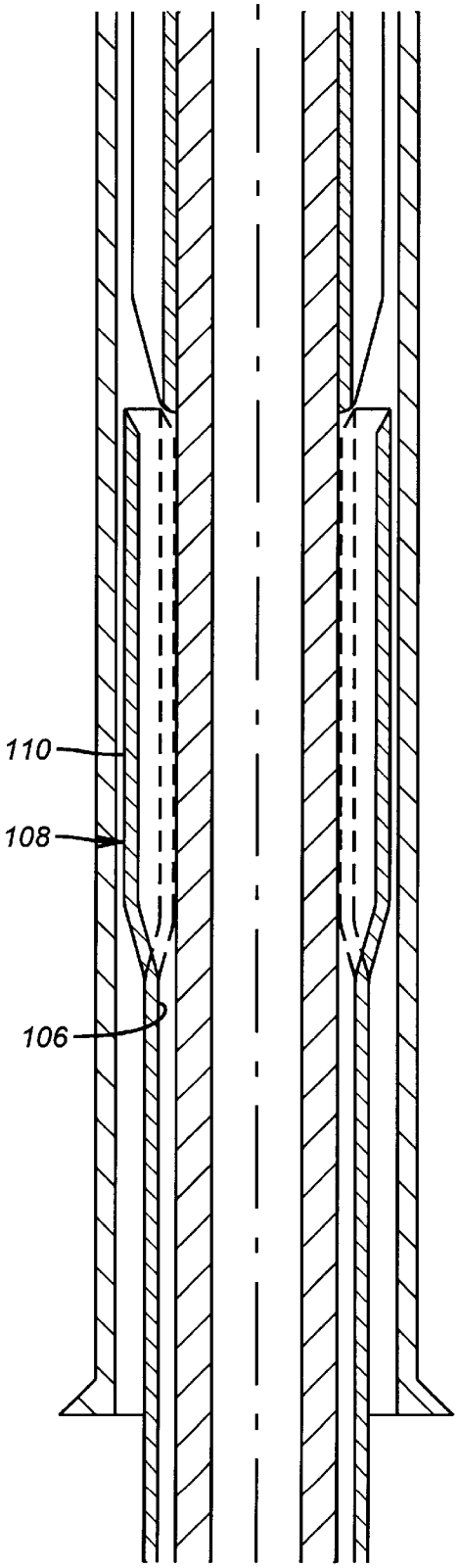

FIGS. 20–25 illustrate yet another alternative of the present invention. In this situation, the sewage assembly 84 has an upper end 86 and a lower end 88. In the run-in position shown in FIG. 20, the upper end 86 is located below a flared out portion 90 of the tubular 92. Located above the upper end 86 is a sleeve 94 which is preferably made of a softer material than the tubular 92, such as aluminum, for example. The outside diameter of the flared out segment 90 is still less than the inside diameter 96 of the casing 98. Ultimately, the flared out portion 90 is to be expanded, as shown in FIG. 21, into contact with the inside wall of the casing 98. Since that distance representing that expansion cannot physically be accomplished by the upper end 96 because of its placement below the flared out portion 90, the sleeve 94 is employed to transfer the radially expanding force to make initial contact with the inner wall of casing 98. The upper end 86 of the sewage assembly 84 has the shape shown in FIG. 22 so that several sections 100 of the tubular 92 will be forced against the casing 98, leaving longitudinal gaps 102 for passage of cement. In the position shown in FIGS. 21 and 22, the passages 102 are in position and the sections 100 which have been forced against the casing 98 fully support the tubular 92. At the conclusion of the cementing operation, the lower segment 88 comes into contact with sleeve 94. The shape of lower end 88 is such so as to fully round out the flared out portion 90 by engaging mid-points 104 of the flared out portion 90 (see FIG. 22) such that the passages 102 are eliminated as the sleeve 94 and the flared out portion 90 are in tandem pressed in a manner to fully round them, leaving the flared out portion 90 rigidly against the inside wall of the casing 98. This is shown in FIG. 23. FIG. 25 illustrates the removal of the sewage assembly 84 and the tubular 92 fully engaged and cemented to the casing 98 so that further completion operations can take place. FIGS. 24 and 26 fully illustrate the flared out portion 90 pushed hard against the casing 98. Again, in this embodiment as in all the others, auxiliary sealing devices can be used between the tubular 92 and the casing 98 and the process is done in a single trip.

Figure 28:
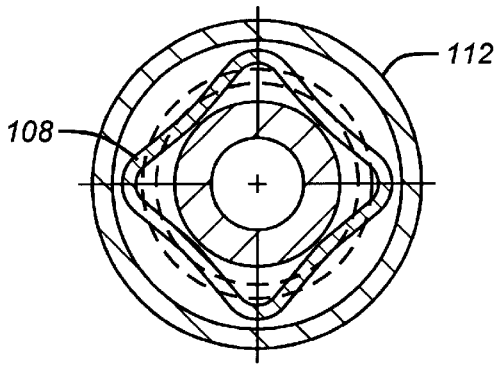
FIGS. 28–30 illustrate an alternative embodiment involving fabrication of the tubular to be inserted to its finished dimension, followed by collapsing it for insertion followed by sequential expansion of it for completion of the operation.
Figure 29:
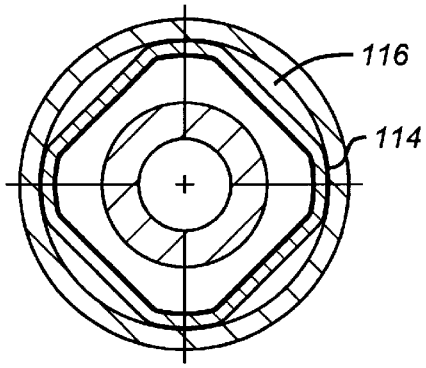
Figure 30:
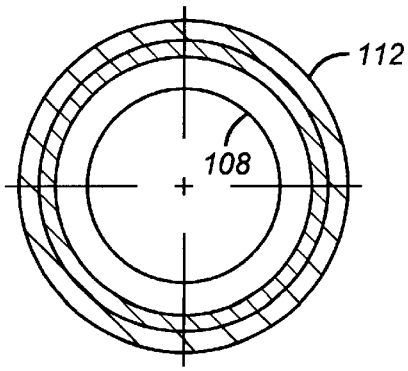

Referring now to FIGS. 27–30, yet another embodiment is illustrated. Again, the similarities in the running in procedure will not be repeated because they are identical to the previously described embodiments. In this situation, the tubular 106 is initially formed with a flared out section 108. The diameter of the outer surface 110 is initially produced to be the finished diameter desired for support of the tubular 106 in a casing 112 (see FIG. 28) in which it is to be inserted. However, prior to the insertion into the casing 112 and as shown in FIG. 28, the flared out section 108 is corrugated to reduce its outside diameter so that it can run through the inside diameter of the casing 112. The manner of corrugation or other diameter-reducing technique can be any one of a variety of different ways so long as the overall profile is such that it will pass through the casing 112. Using a sewage assembly of the type previously described, which is in a shape conforming to the corrugations illustrated in FIG. 28 but tapered to a somewhat larger dimension, the shape shown in FIG. 29 is attained. The shape in FIG. 29 is similar to that in FIG. 28 except that the overall dimensions have been increased to the point that there are locations 114 in contact with the casing 112. These longitudinal contacts in several locations, as shown in FIG. 29, fully support the tubular 106 in the casing 112 and leave passages 116 for the flow of cement. The sewage assembly can be akin to that used in FIGS. 5–11 in the sense that the corrugated shape now in contact with the casing 112 shown in FIGS. 29 at locations 114 can be made into a round shape at the conclusion of the cementing operation. Thus, a second portion of the sewage assembly as previously described is used to contact the flared out portion 108 in the areas where it is still bent, defining passages 116, to push those radially outwardly until a perfect full 360° contact is achieved between the flared out section 108 and the casing 112, as shown in FIG. 30. This is all done in a single trip.

Those skilled in the art can readily appreciate that various embodiments have been disclosed which allow a tubular, such as 10, to be suspended in a running assembly. The running assembly is of a known design and has the capability not only of supporting the tubular for run-in but also to actuate a sewage assembly of the type shown, for example, in FIG. 1 as item 16. What is common to all these techniques is that the tubular is first made to be supported by the casing due to a physical expansion technique. The cementing takes place next and the cementing passages are then closed off. Since it is important to allow passages for the flow of cement, the apparatus of the present invention, in its various embodiments, provides a technique which allows this to happen with the tubular supported while subsequently closing them off. The technique can work with a sewage assembly which is moved downwardly into the top end of the tubular or in another embodiment, such as shown in FIGS. 20–26, the sewage assembly is moved upwardly, out of the top end of the tubular. The creation of passages for the cement, such as 34 in FIG. 8, 76 in FIG. 17A, or 102 in FIG. 22, can be accomplished in a variety of ways. The nature of the initial contact used to support the tubular in the casing can vary without departing from the spirit of the invention. Thus, although four locations are illustrated for the initial support contact in FIG. 8, a different number of such locations can be used without departing from the spirit of the invention. Different materials can be used to encase the liner up and into the casing from which it is suspended, including cement, blast furnace slag, or other materials, all without departing from the spirit of the invention. Known techniques are used for operating the sliding sleeve valve shown in FIGS. 12–15, which selectively exposes the openings 50. Other types of known valve assemblies are also within the spirit of the invention. Despite the variations, the technique winds up being a one-trip operation.

Those skilled in the art will now appreciate that what has been disclosed is a method which can completely replace known liner hangers and allows for sealing and suspension of tubular in larger tubular, with the flexibility of cementing or otherwise encasing the inserted tubular into the larger tubular.

The foregoing disclosure and description of the invention are illustrative and explanatory thereof, and various changes in the size, shape and materials, as well as in the details of the illustrated construction, may be made without departing from the spirit of the invention.

What is claimed is:

1. A method of completing a well, comprising:

running in a tubular string into a cased bore hole;

expanding a portion of said tubular into supporting contact with the casing;

delivering a sealing material through at least one opening in said tubular, with said tubular so supported;

closing off said opening.

2. The method of claim 1, further comprising:

expanding said tubular to accomplish said closing after said delivering of said sealing material.

3. The method of claim 2, further comprising:

using said expanding to close off said opening to accomplish a seal between said tubular and said casing.

4. The method of claim 3, further comprising:

providing a seal down hole of said opening as a backup seal to any seal formed by said expanding.

5. The method of claim 1, further comprising:

pushing said opening against the casing to close it.

6. The method of claim 2, further comprising:

accomplishing said running in, supporting, delivering a sealing material, and closing of said opening by expansion, all in a single trip into the well.

7. The method of claim 1, further comprising:

using full circumferential contact for said supporting contact.

8. The method of claim 7, further comprising:

providing a valve with said opening;

operating said valve to close off said opening.

9. The method of claim 8, further comprising:

providing a sliding sleeve on said tubular string as said valve.

* * * * *